US005822655A

United States Patent [19]

Ikeda

[11] Patent Number: 5,822,655

[45] Date of Patent: Oct. 13, 1998

[54] COLOR IMAGE FORMING APPARATUS HAVING INTERMEDIATE TRANSFER MEMBER

[75] Inventor: Masayuki Ikeda, Kawasaki, Japan

[73] Assignee: Canon Kabushiki Kaisha, Tokyo, Japan

[21] Appl. No.: 665,358

[22] Filed: Jun. 17, 1996

[30] Foreign Application Priority Data

Jun. 18, 1995 [JP] Japan ..... 7-175427

[51] Int. Cl.[6] ..... G03G 15/16

[52] U.S. Cl. ..... 399/121; 399/113; 399/302

[58] Field of Search ..... 399/121, 110, 399/113, 302, 303, 308

[56] References Cited

U.S. PATENT DOCUMENTS 5,220,387 6/1993 Tsunoda et al. ..... 399/121

5,630,194 5/1997 Fujita et al. ..... 399/121 X

*Primary Examiner*—Matthew S. Smith

*Attorney, Agent, or Firm*—Fitzpatrick, Cella, Harper & Scinto

[57] ABSTRACT

The present invention provides a color image forming apparatus having an intermediate transfer member, including an electrophotographic photosensitive member, an image forming unit for forming color toner images on the photosensitive drum, an intermediate transfer member which is moved endlessly and to which the color toner images are successively transferred superimposedly, and a transfer unit for transferring the color toner images transferred to the intermediate transfer member onto a transfer material collectively. The intermediate transfer member is rotatably held by a holding member having holding plates, connecting members interconnecting them, and protruded guide members sliding on a guiding member of the image forming apparatus. The mounting and dismounting of the intermediate transfer member to or from the image forming apparatus is effected by shifting the holding member along a shifting direction of the intermediate transfer member by using the holding plates of the holding member as grips.

13 Claims, 8 Drawing Sheets

COLOR IMAGE FORMING APPARATUS HAVING INTERMEDIATE TRANSFER MEMBER

BACKGROUND OF THE INVENTION

1. Field of the Invention

The present invention relates to an electrophotographic or electrostatic color image forming apparatus, and, more particularly, it relates to a color image forming apparatus (such as a color copying machine, a color laser beam printer and the like) in which visualized images formed on an image bearing member are successively transferred onto an intermediate transfer member and the transferred images are transferred from the intermediate transfer member onto a transfer material collectively, thereby obtaining a color image.

2. Related Background Art

FIG. 8 shows an example of a color laser beam printer. The color laser beam printer includes a drum-shaped electrophotographic photosensitive member (photosensitive drum) 104*a* acting as an image bearing member disposed substantially at a central position within the printer and rotatably supported for rotation in a direction shown by the arrow. Around the photosensitive drum 104*a*, there are disposed a first charger 104*b* for uniformly charging the photosensitive drum 104*a*, a laser beam exposure means 110 for illuminating image information light onto the photosensitive drum to form a latent image on the drum, a rotatable developing means 105A having a plurality of developing devices 105 (105M, 105C, 105Y and 105K) for developing the latent image as a visualized image (toner image), and a transfer material bearing member (transfer drum) 103*a* for bearing and conveying a transfer material 102 supplied from a sheet supply device 1. The toner image formed on the photosensitive drum 104*a* is transferred onto the transfer material 102 born on the transfer drum 103*a*. The residual toner remaining on the photosensitive drum 104*a* is removed by a cleaner 104*c* for preparing for a next image forming process.

By repeating the above-mentioned image forming process, different color toner images are transferred onto the transfer material 102 born on the transfer drum 103*a* in a superimposed fashion. Explaining the elements of the printer, the first charger 104*b* comprises a charge roller to which voltage is applied and which is urged against the photosensitive drum 104*a* to uniformly charge a surface of the photosensitive drum 104*a* prior to the latent image formation.

The exposure means 110 includes a scanner portion 110*a* having a laser diode which serves to emit a laser beam in response to an image signal, which laser beam is incident on a polygon mirror. The polygon mirror is rotated by a scanner motor at a high speed, thereby reflecting the laser beam. The laser beam reflected by the polygon mirror selectively exposes the peripheral surface of the photosensitive drum 104*a* through a focusing lens 110*b* and a reflection mirror 110*c*, in response to the image signal. Due to the laser exposure, the electrostatic latent images corresponding to various color components can be formed on the photosensitive drum 104*a*.

As mentioned above, the rotatable developing means 105A comprises a plurality of different color developing devices 105, i.e. a magenta developing device 105M including magenta toner, a cyan developing device 105C including cyan toner, a yellow developing device 105Y including yellow toner, and a black developing device 105K including black toner. These four color developing devices 105 are supported for rotation around a shaft 105*e*, and centers of the developing devices are rotated by a rotation gear disposed around and meshed with a revolution gear, thereby maintaining the postures of the developing devices at predetermined orientation.

In the image formation, the developing device 105 including the color toner corresponding to the color component of the latent image is brought to a developing position where it is opposed to the photosensitive drum 104*a*. At that position, a developing sleeve 105*b* of the developing device is opposed to the photosensitive drum 104*a* with a small gap. When the developing device 105 is shifted to the developing position, the developing device is connected to a high voltage source of the printer, so that the developing bias is applied to the developing sleeve 105*b* and at the same time the developing device is connected to a drive means (connected to a drive source) to rotate the developing sleeve 105*b*. During the developing operation, when the developing sleeve 105*b* is subjected to the developing bias and the rotation, the latent image on the photosensitive drum 104*a* is developed to form the toner image.

The sheet supply portion 101 serves to supply the transfer material to the transfer drum 103 and includes a sheet supply cassette 101*a* containing the transfer materials 102 therein and removably mounted within the printer at a lower portion thereof. In the image formation, a sheet supply roller 101*b* is rotated in synchronous with the image forming operation, thereby supplying and separating the transfer materials from the cassette 101*a* one by one, and the separated transfer material is supplied to the transfer drum 103. The supplied transfer material 102 is wound around the transfer drum 103. The transfer drum 103 is rotated at a speed (for example, 4 mm/sec.) same as the outer peripheral speed of the photosensitive drum 104*a* in order to transfer the different color toner images formed on the photosensitive drum 104*a* onto the transfer material 102 at a transfer station.

The transfer drum 103 is constituted by an aluminum cylinder 103*a* having a diameter of 180 mm, an elastic layer 103*b* made of sponge, rubber and the like and coated on the cylinder, a resistance layer 103*c* coated on the elastic layer, and an outermost dielectric layer 103*d* coated on the resistance layer. Grippers 103*f* for gripping a tip end of the supplied transfer material 102 are provided on an outer peripheral surface of the transfer drum 103 at a predetermined position. Further, there is provided an electrostatic absorption roller 103*g* which can be contacted with and separated from the outer peripheral surface of the transfer drum 103 so that the transfer material 102 is pinched between the roller 103*g* and the transfer drum 103, thereby urging the transfer material against the outer peripheral surface of the transfer drum 103. By applying voltage between the absorption roller 103*g* and the transfer drum 103, the charges are created in the transfer material (dielectric material) 102 and the dielectric layer 103*d* of the transfer drum 103, thereby electrostatically absorbing the transfer material 102 on the transfer drum 103.

The cleaner 104*c* serves to remove the residual toner remaining on the photosensitive drum 104*a* after the toner image is transferred to the transfer material, and is disposed around the outer peripheral surface of the photosensitive drum 104*a* at a downstream side of the transfer station. A fixing portion 106 comprises a driven pressure roller 106*a*, and a fixing roller 106*b* urged against the pressure roller to apply heat and pressure to the transfer material 102. By passing the transfer material 102 (to which the different color toner images were transferred and which was separated from the transfer drum 103) between the fixing roller and the pressure roller, the toner images are fixed to the transfer material 102.

In the image formation, the transfer material 102 is supplied from the sheet supply cassette 101*a* to the transfer drum 103 by means of the sheet supply roller 101*b*. The transfer material 102 is gripped by the grippers 103*f* and is electrostatically absorbed around the transfer drum 103.

On the other hand, after the photosensitive drum 104*a* is uniformly charged by the first charger 104*b*, the photosensitive drum is exposed by the magenta color component laser beam from the scanner portion 110*a*, thereby forming the latent image corresponding to the magenta color component on the drum. At the same time, the magenta developing device 105M is driven so that the developing bias voltage having the same potential as but opposite polarity to the charging polarity of the photosensitive drum 104*a* is applied to the developing device to adhere the magenta toner to the magenta latent image formed on the photosensitive drum 104*a*, thereby forming the magenta toner image on the photosensitive drum 104*a*. Then, by applying the transfer potential having the polarity opposite to that of the magenta toner to the transfer drum 103, the magenta toner image on the photosensitive drum 104*a* to the transfer material 102.

After the magenta toner image was transferred to the transfer material, by repeating the similar process, the formation of the latent image, the development of the latent image and the transferring of the toner image are successively performed regarding cyan, yellow and black colors, thereby forming a full color image on the transfer material 102.

After the transfer drum 103 bearing the transfer material 102 thereon is rotated by four revolutions, a four-color (full-color) image can be obtained. That is to say, in this example, one full-color image is outputted by 30 seconds ($=180\pi\times4/75.4$). The transfer material to which the four color toner images were transferred is separated from the transfer drum 103, and the separated transfer material is sent to the fixing portion 106, where the toner images are fixed to the transfer material. Thereafter, the transfer material is discharged onto a discharge tray by a pair of discharge rollers 107.

By the way, in the above-mentioned conventional color laser beam printer, when the transfer drum 103 is exchanged or when the sheet jam treatment is performed, in order that the transfer drum can be retracted toward a front side of the printer along a drum center line 103*e*, a portion of a frame of the printer must be greatly removed. As a result, the rigidity of the printer is reduced, and the image quality is deteriorated due to the reduction of the rigidity. Further, since the transfer drum 103 is retracted toward the front side of the printer, the handling ability for the transfer drum 103 is worsened, and guide rails for retraction must be provided, thereby increasing the manufacturing cost.

SUMMARY OF THE INVENTION

An object of the present invention is to provide a color image forming apparatus utilizing an intermediate transfer member, in which a frame of the apparatus is not greatly removed, the handling ability can be improved, and the reduction of the rigidity of the apparatus and the deterioration of the image quality can be prevented.

To achieve the above object, according to the present invention, there is provided a color image forming apparatus utilizing an intermediate transfer member, comprising an electrophotographic photosensitive member, an image forming means for forming color toner images on the photosensitive drum, an intermediate transfer member which is moved along an endless paths and to which the color toner images are successively transferred in a superimposed fashion, and a transfer means for transferring the color toner images transferred to the intermediate transfer member onto a transfer material collectively. The intermediate transfer member is rotatably held by a holding means having side hold plates, connecting members for interconnecting the side hold plates, and protruded guide members slid on guiding members of the apparatus. The mounting and dismounting of the intermediate transfer member with respect to the apparatus is effected by shifting the holding means along a shifting direction of the intermediate transfer member by using the holding plates of the holding means as grips.

DETAILED DESCRIPTION OF THE PREFERRED EMBODIMENTS

A color image forming apparatus according to the present invention will now be explained with reference to the accompanying drawings.

Figure 6:
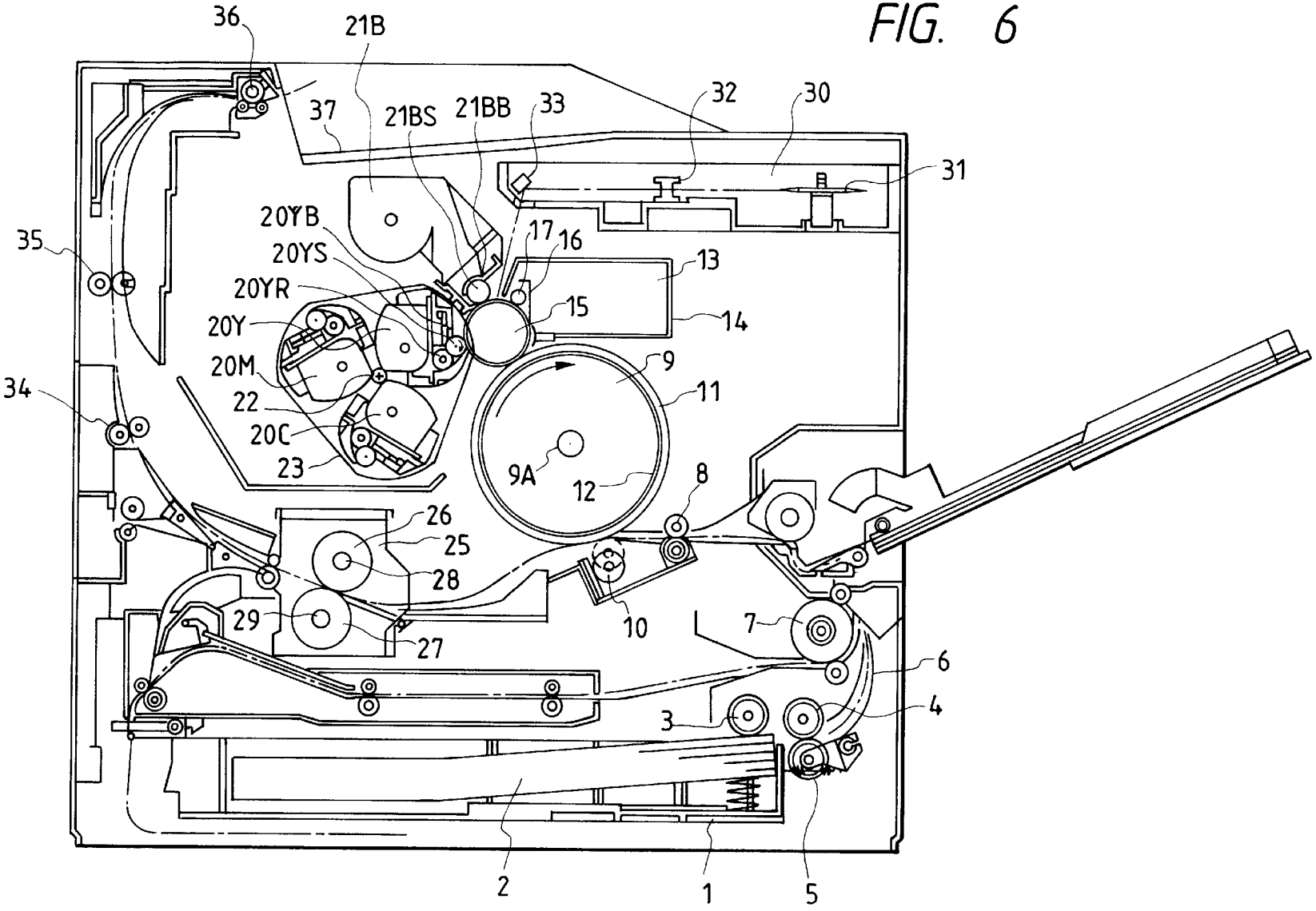
FIG. 6 is a sectional view of a color laser beam printer according to the present invention.

FIG. 6 shows a color laser beam printer embodied as an embodiment (color image forming apparatus) of the present invention.

In this embodiment, there is provided an image forming portion having an image bearing member (photosensitive drum) 15. In order to form a visualized image, around the image bearing member 15, there are provided a charge means, an exposure means and a developing means. The visualized images formed on the image bearing member 15 are transferred onto an intermediate transfer member 9 in a superimposed fashion. Thereafter, the images transferred to the intermediate transfer member 9 are collectively transferred onto a transfer material 2 (supplied from a sheet supply portion), thereby forming a full-color image. The transfer material 2 is then sent to a fixing means 25, where the full-color image is fixed to the transfer material 2. Then, the transfer material is discharged onto a discharge portion 37 on the apparatus by a pair of discharge rollers.

Next, elements in the image forming portion will be explained.

[Image bearing member unit]

The image bearing member (photosensitive drum) 15 and a container 14 (acting as a holder for the image bearing member 15) of a cleaning device are integrally formed to define a drum unit 13. The drum unit 13 is removably supported by the printer so that it can easily be exchanged in dependence upon the service life of the image bearing member 15. The image bearing member 15 comprises an aluminium cylinder having a diameter of 60 mm, and an organic photo-conductive layer coated on the cylinder, and is rotatably supported by a container (acting as a holder for the image bearing member 15) 14 of a cleaning device.

A cleaner blade 16 and a first charge means 17 are disposed around the image bearing member 15. Further, by transmitting a driving force of a drive motor (not shown) to rear end of the image bearing member 15, the image bearing member 15 is rotated in an anti-clockwise direction in response to an image forming operation.

[Charge means]

The charge means 17 is of contact charge type and comprises a conductive roller contacted with the image bearing member 15. By applying voltage to the conductive roller, a surface of the image bearing member 15 is uniformly charged.

[Exposure means]

The exposure of the image bearing member 15 is effected by a scanner portion 30. That is to say, when an image signal is sent to a laser diode, the laser diode emits image light corresponding to the image signal to a polygon mirror 31. The polygon mirror 31 is rotated at a high speed by means of a scanner motor, so that the image light reflected by the polygon mirror 31 selectively exposes the surface of the image bearing member 15 (rotated at a constant speed) through a focusing lens 32 and a reflection mirror 33, thereby forming an electrostatic latent image on the image bearing member 15.

[Developing means]

A developing means serves to visualize the latent image formed on the image bearing member 15 as a toner image and comprises a rotatable developing means 20 having three rotatable color developing devices 20Y, 20M and 20C mounted on a developing rotary, and a fixed developing means 21 having a fixed black developing device 21B so that yellow, magenta, cyan and black toner images can be obtained. Further, the rotatable color developing devices and the fixed black developing device is removable with respect to the printer independently.

The fixed black developing device 21B is disposed at a position where a developing sleeve 21BS is opposed to the image bearing member 15 with a small gap (of about 300 μm, for example) so that a black toner image can be formed on the image bearing member 15. In the black developing device 21B, toner is supplied from a container by a toner feed mechanism, and a thin toner layer is formed on an outer peripheral surface of the sleeve 21BS (rotated in an anti-clockwise direction) by a coating blade 21BB urged against the sleeve 21BS. During the formation of the toner layer, the toner is frictionally charged. Further, by applying developing bias to the sleeve 21BS, the latent image on the image bearing member 15 is developed.

The three rotatable developing devices 20Y, 20M and 20C are removably mounted on the developing rotary 23 rotated around a shaft 22. In the image formation, the developing devices are rotatably shifted around the shaft 22 while being held on the developing rotary 23 so that a selected developing device is stopped at a developing station where the selected developing device is opposed to the image bearing member 15. In this condition, a developing sleeve of the selected developing device is opposed to the image bearing member 15 with a small gap (of about 300 μm, for example). Then, the color toner image is formed on the image bearing member 15. In the color image formation, whenever the intermediate transfer member 9 is rotated by one revolution, the developing rotary 23 is rotated. Consequently, while the intermediate transfer member 9 is rotated by four revolutions, the developing operations are successively effected by the yellow developing device 20Y, magenta developing device 20M, cyan developing device 20C and black developing device 21B, thereby forming the yellow, magenta, cyan and black toner images on the intermediate transfer member 9 successively to obtain a full-color toner image.

FIG. 6 shows a condition that the yellow developing device 20Y is positioned at the developing station. In the rotatable yellow developing device 20Y, toner in a container is sent to a coating roller 20YR by a toner feed mechanism, and a thin toner layer is formed on an outer peripheral surface of a sleeve 20YS (rotated in a clockwise direction) by the coating roller 20YR (rotated in a clockwise direction) and a blade 20YB urged against the sleeve 20YS. During the formation of the toner layer, the toner is frictionally charged. By applying developing bias to the sleeve 20YS opposed to the image bearing member 15, the latent image on the image bearing member 15 is developed as the yellow toner image. The operations of the magenta developing device 20M and the cyan developing device 20C are the same as that of the yellow developing device 20Y.

The sleeves of the rotatable developing devices 20Y, 20M and 20C is connected to a high voltage source and a drive source of the printer when the respective developing devices are brought to the developing station, so that the voltage is selectively applied to the active sleeve and the active sleeve is rotatingly driven.

[Intermediate transfer member]

The intermediate transfer member 9 is rotated in a clockwise direction in synchronous with a peripheral speed of the image bearing member 15 in order that the different color toner images on the image bearing member 15 can be transferred onto the intermediate transfer member in a superimposed fashion. While the transfer material 2 is being passed between the intermediate transfer member 9 on which the different color toner images were superimposed and a transfer roller 10 to which voltage is applied, the different color toner images on the intermediate transfer member 9 are transferred onto the transfer material 2 collectively. The intermediate transfer member 9 is constituted by an aluminium cylinder 12 having a diameter of 180 mm, and an elastic layer 11 made of intermediate resistance sponge or intermediate resistance rubber and coated on the cylinder. The intermediate transfer member 9 is rotatably supported so that it can be rotated by transmitting a driving force to a gear (not shown) of the intermediate transfer member.

[Cleaning means]

A cleaning means serves to remove the toner remaining on the image bearing member 15 after the toner image on the image bearing member 15 was transferred to the intermediate transfer member 9, and the removed toner is collected into the cleaner container 14. The container 14 is not filled with the waste toner before the service life of the image bearing member 15 expires. Thus, when the image bearing member 15 is exchanged to a new one, the container 14 may be exchanged to a new one.

[Sheet supply portion]

A sheet supply portion serves to supply the transfer material 2 to the image forming portion and comprises a cassette 1 containing a plurality of transfer materials 2, a sheet supply roller 3, a feed roller 4, a double-feed preventing retard roller 5, a sheet supply guide 6, and a convey roller 7. In the image formation, the sheet supply roller 3 is rotated in synchronous with the image forming operation to supply the transfer material 2 from the cassette 1 one by one. The supplied transfer material is guided by the sheet supply guide 6 to reach a pair of regist rollers 8 through the convey roller 7. During the image forming operation, the pair of regist rollers 8 perform non-rotation sequence for waiting or stopping the transfer material 2 and rotation sequence for conveying the transfer material 2 toward the intermediate transfer member 9, thereby effecting the registration between the toner image (to be transferred) and the transfer material 2.

[Transfer station]

The transfer station includes the transfer roller 10. The transfer roller 10 is constituted by a cylindrical roller made of intermediate resistance foam elastic material and having a central metal shaft. The roller can be shifted in an up-and-down direction and be rotated.

The transfer roller 10 is spaced apart from the intermediate transfer member 9 as shown by the solid line in FIG. 6 in order to prevent the distortion of the image(s) while the four color toner images being transferred onto the intermediate transfer member 9 (i.e. while the intermediate transfer member 9 is being rotated by four revolutions). After the four color toner images were transferred to the intermediate transfer member 9, in synchronous with the transferring of the color toner images to the transfer material 2, the transfer roller 10 is shifted to a position shown by the broken line in FIG. 6 by means of a cam member (not shown), so that the transfer roller is urged against the intermediate transfer member 9 with the interposition of the transfer material 2 with predetermined pressure. At the same time, bias voltage is applied to the transfer roller 10, with the result that the toner images on the intermediate transfer member 9 are transferred onto the transfer material 2 collectively.

Since the intermediate transfer member 9 and the transfer roller 10 are rotatingly driven, the transfer material 2 pinched between these elements 9 and 10 is conveyed to left (FIG. 6) at a predetermined speed while the toner images being transferred onto the transfer material. As a result, the transfer material is sent to a fixing portion 25.

[Fixing portion]

Figure 4:
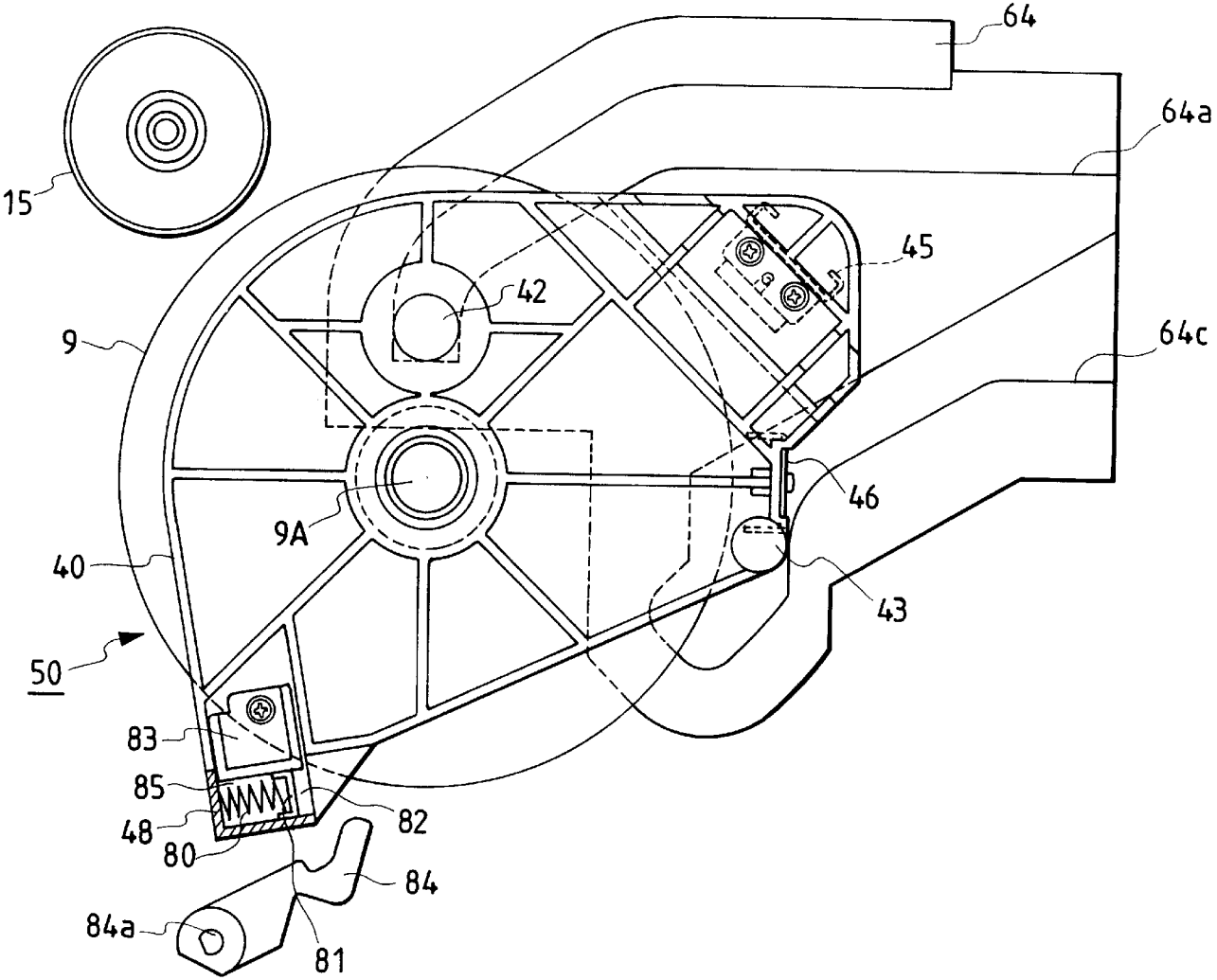
FIG. 4 is a fragmental side view of a pressure member containing portion, for explaining the mounting, dismounting and rocking of the intermediate transfer member unit of FIG. 1 with respect to the image forming apparatus, and showing a conditions that the intermediate transfer member unit is spaced apart from an image be ring member.

The fixing portion 25 serves to fix the toner images (formed by the developing means 20, 21 and transferred from the intermediate transfer member 9 to the transfer material 2) to the transfer material. As shown in FIG. 4, the transfer portion 25 comprises a fixing roller 26 for applying heat to the transfer material 2, and a pressure roller 27 for urging the transfer material 2 against the fixing roller 26. The rollers 26, 27 have heaters 28, 29 therein and serve to convey the transfer material 2 by their rotations. That is to say, the transfer material 2 to which the toner images were fixed is conveyed by the rollers 26, 27; meanwhile, by applying heat and pressure to the transfer material, the toner is fixed to the transfer material 2.

[Image forming operation]

Next, the image forming operation of the printer will be explained with reference to FIG. 7.

First of all, the sheet supply roller shown in FIG. 6 is rotated to supply the single transfer material 2 from the cassette 1 to the pair of regist rollers 8.

On the other hand, the image bearing member 15 and the intermediate transfer member 9 are rotated in the directions shown by the arrows at the peripheral speed V of 75.4 mm/sec. (referred to as "process speed" hereinafter). The image bearing member 15 having the diameter of 60 mm is rotated by one revolution by 2.5 seconds ($=60\pi/75.4$) and the intermediate transfer member 9 having the diameter of 180 mm is rotated by one revolution by 7.5 seconds ($=180\pi/75.4$). Since the image bearing member 15 and the intermediate transfer member 9 are connected to each other via gears (not shown), when the image bearing member 15 is rotated by three revolution, the intermediate transfer member 9 is correctly rotated by one revolution.

Figure 7:
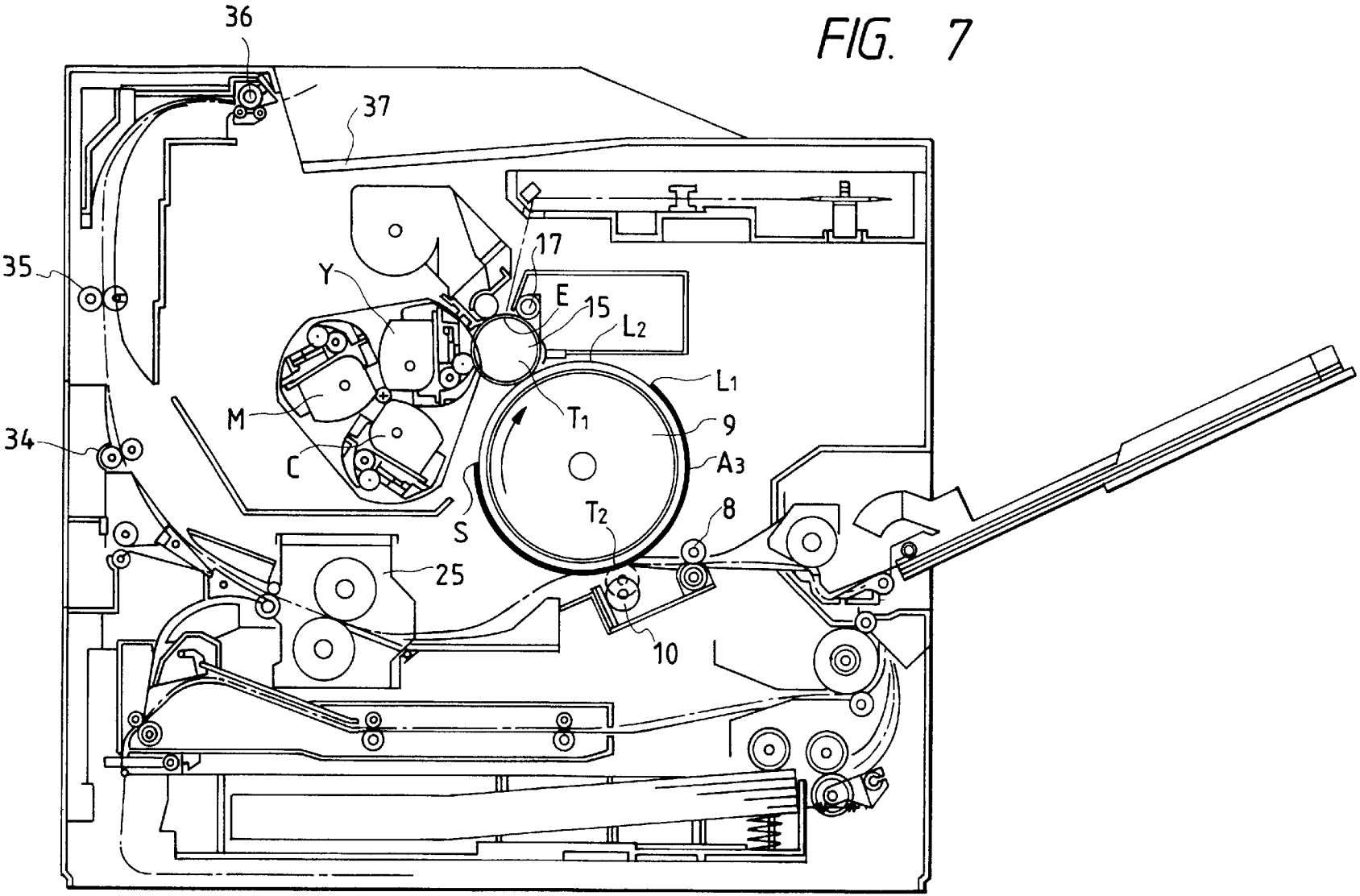
FIG. 7 is a sectional view of the color printer showing A3 size image formation.
Figure 8:
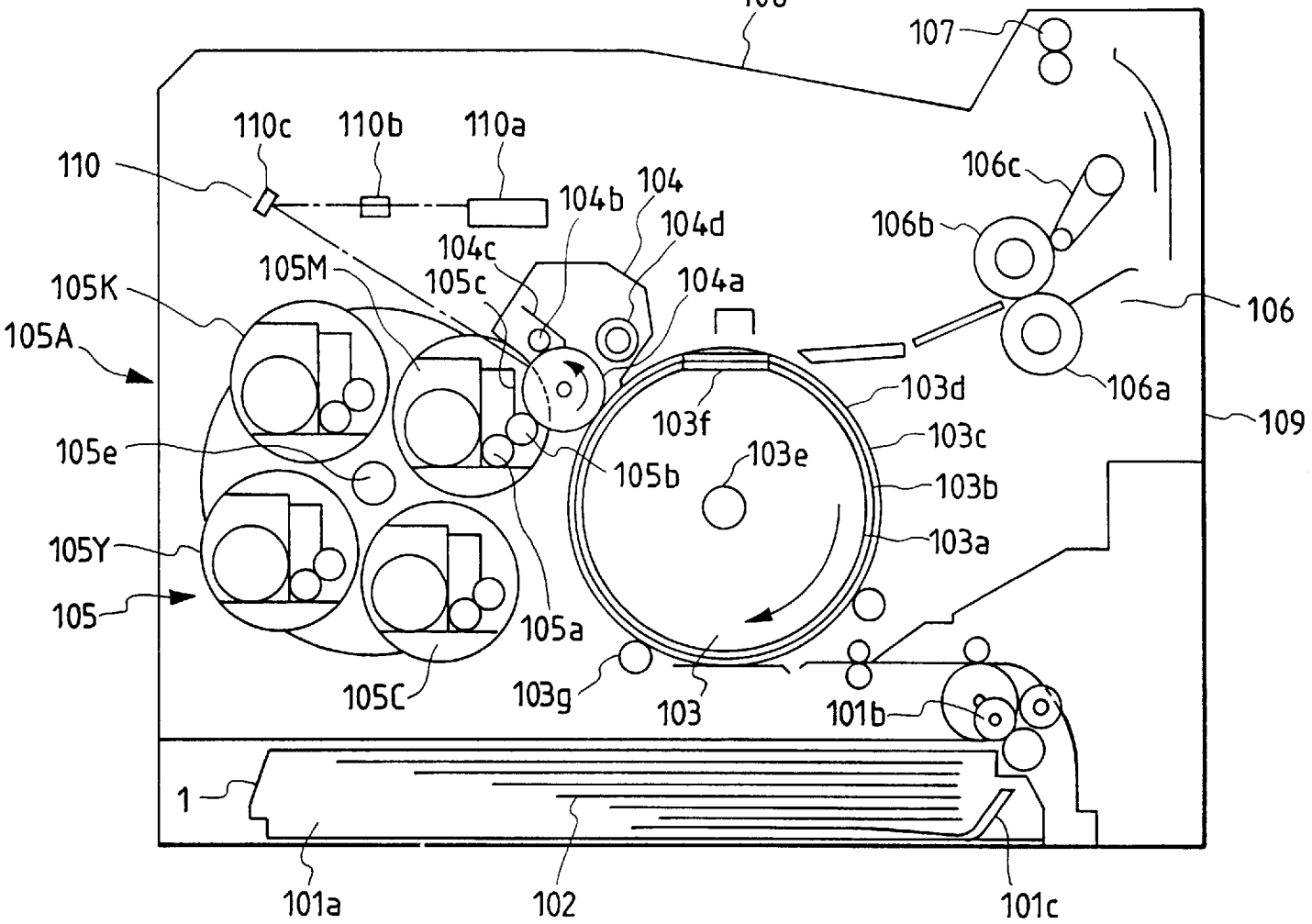
FIG. 8 PRIOR ART
FIG. 8 is a sectional view of a conventional image forming apparatus.

In FIG. 7, when any point on the peripheral surface of the intermediate transfer member 9 reaches a position S, the image bearing member 15 uniformly charged by the charge means 17 is laser-exposed at a position E, thereby forming the latent image. A distance between the exposure position E and a position $T_1$ (contact position between the image bearing member and the intermediate transfer member 9) in the anti-clockwise direction is the same as a distance between the position S and the position $T_1$ in the clockwise. Thus, after a predetermined time is elapsed, the image writing start position E will coincide with the point S at the position $T_1$. That is to say, the image is written on the intermediate transfer member 9 from the point S in an anti-clockwise direction.

(1) Formation of yellow image

Yellow component laser light is illuminated on the image bearing member by the scanner portion 30, thereby forming the latent image corresponding to the yellow component on the image bearing member 15. At the same time as the latent image formation, the yellow developing device 20Y is driven to apply the voltage having the same polarity and potential as those of the image bearing member 15 to the developing device, thereby adhering the yellow toner to the latent image to form the yellow toner image. Then, at a first transfer position $T_1$ disposed at a downstream side of the developing station, the yellow toner image on the image bearing member 15 is transferred onto the intermediate transfer member 9. In this case, the voltage having the polarity opposite to that of the yellow toner image is applied to the intermediate transfer member 9.

When the dimension of the image is A3 size, a length of the image is 420 mm. Thus, the image is formed on the intermediate transfer member 9 from the point S to a point $L_1$ (shown by the fat solid line in FIG. 7). After the yellow toner image is transferred to the intermediate transfer member 9, i.e., after the point $L_1$ passes through the first transfer position $T_1$, the developing rotary 23 is rotated in the clockwise direction to bring the next magenta developing device 20M to the developing station to oppose it to the image bearing member 15.

(2) Formation of magenta image

Then, after the intermediate transfer member 9 is rotated by one revolution, when the point S (image tip end of the yellow image) on the intermediate transfer member reaches the point S as shown again, similarly, magenta component laser light is illuminated on the image bearing member by the scanner portion 30, thereby forming the latent image corresponding to the magenta component on the image bearing member 15. The latent image is developed by the magenta developing device 20M, and then, the magenta toner image is similarly transferred onto the intermediate transfer member 9 at the first transfer position $T_1$. After the magenta toner image is transferred to the intermediate transfer member 9, i.e., after the point $L_1$ passes through the first transfer position $T_1$, the developing rotary 23 is rotated in the clockwise direction to bring the next cyan developing device 20C to the developing station to oppose it to the image bearing member 15.

(3) Formation of cyan image

Then, after the intermediate transfer member 9 is rotated by one revolution, when the point S (image tip ends of the yellow and magenta images) on the intermediate transfer member reaches the point S as shown again, similarly, cyan component laser light is illuminated on the image bearing member by the scanner portion 30, thereby forming the latent image corresponding to the cyan component on the image bearing member 15. The latent image is developed by the cyan developing device 20C, and then, the cyan toner image is similarly transferred onto the intermediate transfer member 9 at the first transfer position $T_1$ in the superimposed fashion. After the cyan toner image is transferred to the intermediate transfer member 9, i.e., after the point $L_1$ passes through the first transfer position $T_1$, the developing rotary 23 is rotated in the clockwise direction by 60 degrees, with the result that no developing device is opposed to the image bearing member 15.

(4) Formation of black image

Then, after the intermediate transfer member 9 is rotated by one revolution, when the point S (image tip ends of the yellow, magenta and cyan images) on the intermediate transfer member reaches the point S as shown again, similarly, black component laser light is illuminated on the image bearing member by the scanner portion 30, thereby forming the latent image corresponding to the black component on the image bearing member 15. The latent image is developed by the black developing device 21B, and then, the black toner image is similarly transferred onto the intermediate transfer member 9 at the first transfer position $T_1$ in the superimposed fashion.

In this way, the latent image formation, development and the transferring of the toner image (onto the intermediate transfer member 9) are repeated by four times regarding the yellow, magenta, cyan and black colors, thereby forming the full-color (comprised of yellow, magenta, cyan and black colors) on the intermediate transfer member 9.

Before the transferring of the black toner image to the intermediate transfer member 9 is finished, i.e., before the image tip end S of the intermediate transfer member 9 (after the black toner image was transferred) reaches a second transfer position $T_2$, the transfer material 2 stopped by the pair of regist rollers 8 starts to be conveyed at the proper timing.

At the same time, the transfer roller 10 is urged against the intermediate transfer member 9 by the cam member (not shown) at the second transfer position $T_2$ with the interposition of the transfer material 2, and at the same time, by applying the bias having the polarity opposite to that of the toner to the transfer roller 10, the four different color toner images (full-color image) on the intermediate transfer member 9 are transferred onto the transfer material 2 collectively.

The transfer material 2 left from the second transfer position $T_2$ is separated from the intermediate transfer member 9 and then is sent to the fixing position 25, where the toner images are fixed to the transfer material. Thereafter, the transfer material is discharged onto a discharge tray 37 (provided on the printer) with the imaged surface facing downside through pairs of discharge rollers 34, 35 and 36. In this way, the image forming operation is finished.

As mentioned above, it can be understood that the intermediate transfer member 9 is rotated by four revolutions for 30 seconds (7.5 seconds×4) in order to obtain one full color image copy. Incidentally, the image bearing member 15 having the peripheral speed V same as that of the intermediate transfer member 9 is rotated by twelve revolutions in order to obtain one full color image copy, due to the ratio between the diameters of the image bearing member and the intermediate transfer member 9.

Since the intermediate transfer member 9 has the diameter of 180 mm, the peripheral length of the member becomes about 565 mm. In the formation of A3 size image, a portion of 420 mm of the peripheral length of the member is used. That is to say, a distance between the point S on the outer periphery of the intermediate transfer member and the position $L_1$ in the anti-clockwise direction is 420 mm (shown by the fat solid line in FIG. 7). Thus, the portion of 420 mm of the peripheral length of the member is used to the image formation, and the remaining portion of 145 mm is not used to the image formation. Since the intermediate transfer member 9 is rotated at the constant process speed V (=75.4 mm/sec.), in the A3 size full-color image formation, there is non-image forming time of 1.92 seconds (145/75.4). This non-image forming time is used to switch the developing devices.

The time for switching the developing device 20Y situated at the developing position between the laser exposure position E for the image bearing member 15 and the first transfer position $T_1$ to the next developing device 20M corresponds to the time during which the point S reaches the first transfer position $T_1$.

Next, the features of the present invention will be explained with reference to FIGS. 1 to 3.

Figure 1:
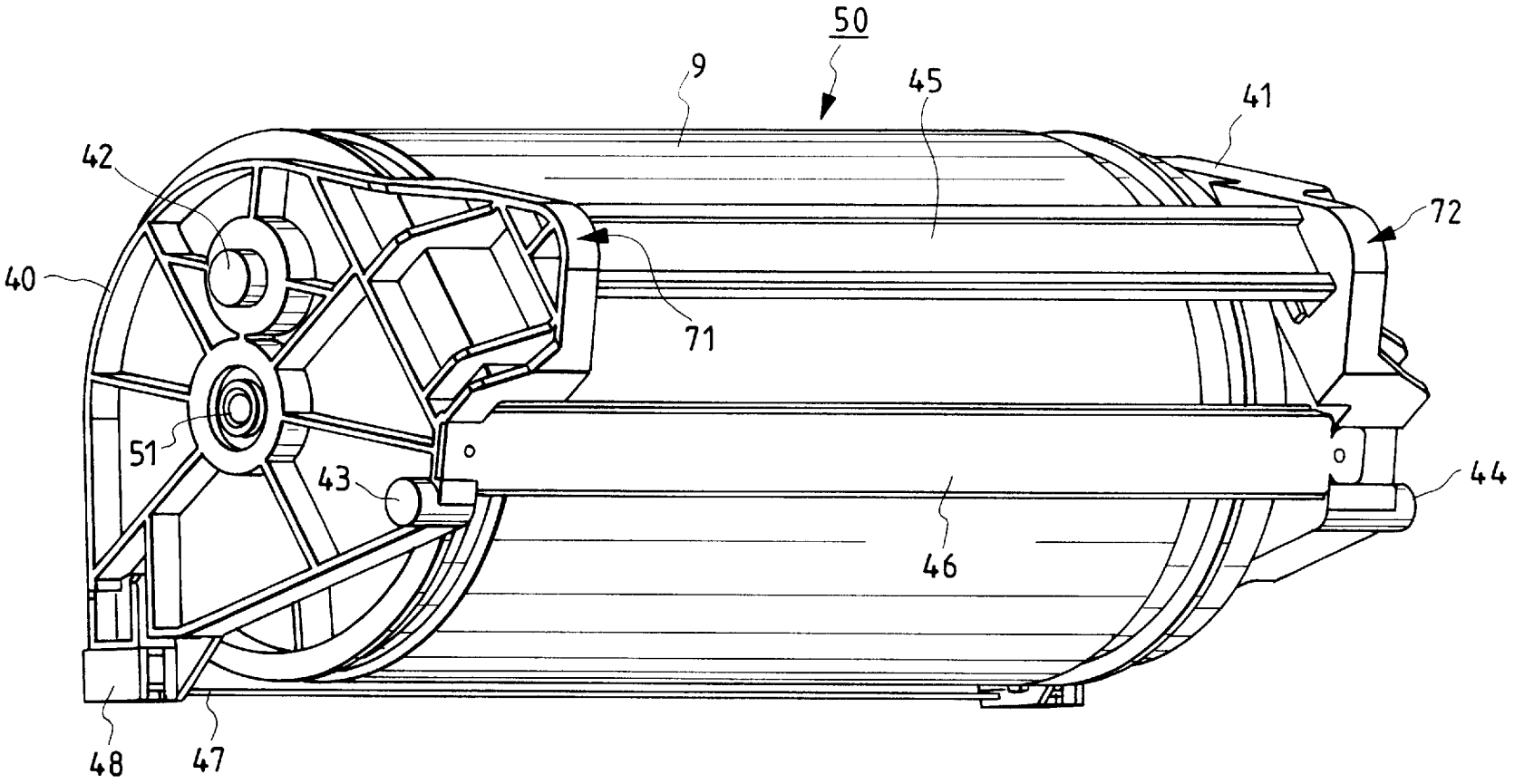
FIG. 1 is a perspective view of an intermediate transfer member unit used with a color image forming apparatus according to a preferred embodiment of the present invention.

As shown in FIG. 1, in the present invention, both ends (only one end 51 is shown in FIG. 1) of a shaft 9A of the intermediate transfer member 9 are held by holding members 40, 41 having the same construction, and the holding members 40, 41 are interconnected by connection members 45, 46 and 47, thereby forming an intermediate transfer member unit 50. The intermediate transfer member unit 50 is removable with respect to the printer.

More specifically, the holding members 40, 41 are provided with protruded guide members 42 (guide member of the holding member 41 is not shown) for guiding the intermediate transfer member unit 50 along guiding members 63, 64 provided on side plates 61, 62 of the printer, and posture controlling protruded guide members 43, 44 for controlling the posture of the intermediate transfer member unit 50 when the latter is mounted or dismounted along the guiding members 63, 64. The holding members 40, 41 are provided with grip portions 71, 72 for gripping or handling the intermediate transfer member unit 50. The grip portions 71, 72 may have any configuration so long as the intermediate transfer member unit 50 can be handled via the grip portions. Further, the grip portions may be attached to the holding members.

Figure 2:
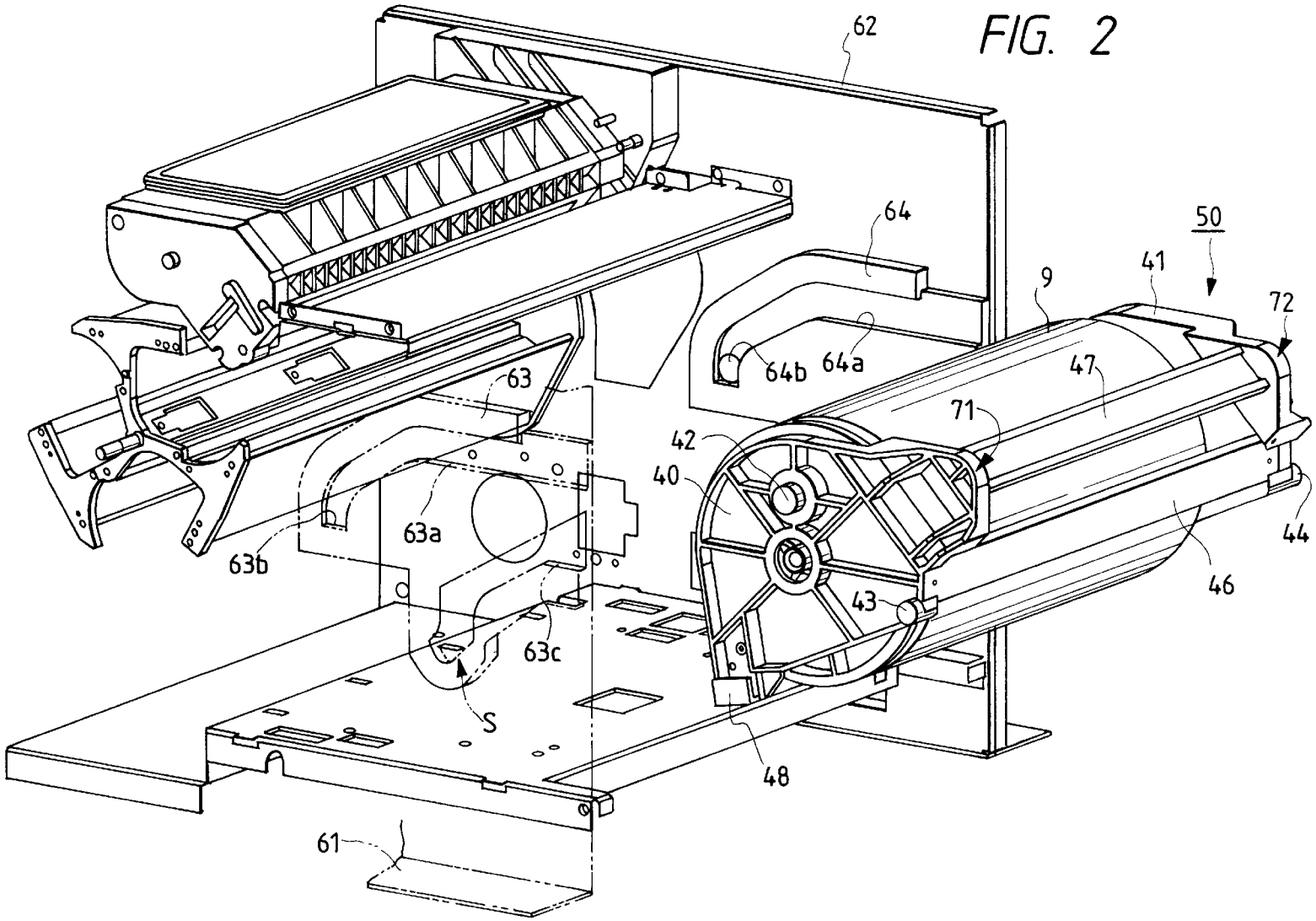
FIG. 2 is a perspective view for explaining the mounting and dismounting of the intermediate transfer member unit of FIG. 1 with respect to the image forming apparatus.

FIG. 2 is a view for explaining the mounting and dismounting of the intermediate transfer member unit 50 with respect to the printer. In FIG. 2, a portion of the side plate and associated elements are omitted from illustration or are shown by the phantom lines, and the intermediate transfer member unit 50 is shown in a floating condition (handled by the operator's hands).

The guiding members 63, 64 are attached to the side plates 61, 62 of the printer, and the guiding members 63, 64 have guide surfaces 63*a*, 64*a* for guiding the protruded guide members of the intermediate transfer member unit 50, and support portions 63*b*, 64*b* for supporting the intermediate transfer member unit 50.

Next, the mounting of the intermediate transfer member unit 50 to the printer will be explained.

Referring to FIG. 2, the operator grips the grip portions 71, 72 of the intermediate transfer member unit 50. While handling the intermediate transfer member unit 50, the protruded guide member 42 of the holding member 40 is rested on the guide surface 63*a* of the guiding member 63 and at the same time protruded guide member (not shown) of the holding member 41 is rested on the guide surface 64*a* of the guiding member 64. Then, the intermediate transfer member unit 50 is inserted into the printer while sliding the former. In this case, at the same time, the posture controlling protruded guide members 43, 44 of the holding members 40, 41 are slid along other guide surfaces 63*c*, 64*c* (guide surface 64*c* is shown in FIG. 3). As a result, since the posture of the intermediate transfer member unit 50 is controlled in accordance with the design of the guide surfaces 63*a*, 64*a*, the intermediate transfer member unit can easily be inserted into the printer without any interference.

Eventually, the intermediate transfer member unit 50 is held in the printer by supporting the protruded guide members by the support portions 63*b*, 64*b* of the guiding members 63, 64. The dismounting of the intermediate transfer member unit from the printer can be easily effected merely by retracting the intermediate transfer member unit from the guiding members.

According to the illustrated embodiment, in order to contact the intermediate transfer member 9 with the image bearing member 15, the intermediate transfer member unit 50 can be rocked around the protruded guide member 42 of the holding member 40 and the protruded guide member (not shown) of the holding member 41. Portions S of the guiding members 63, 64 (see FIGS. 2 and 3) provide clearances G for permitting the rocking movements of the posture controlling protruded guide members 43, 44.

Figure 3:
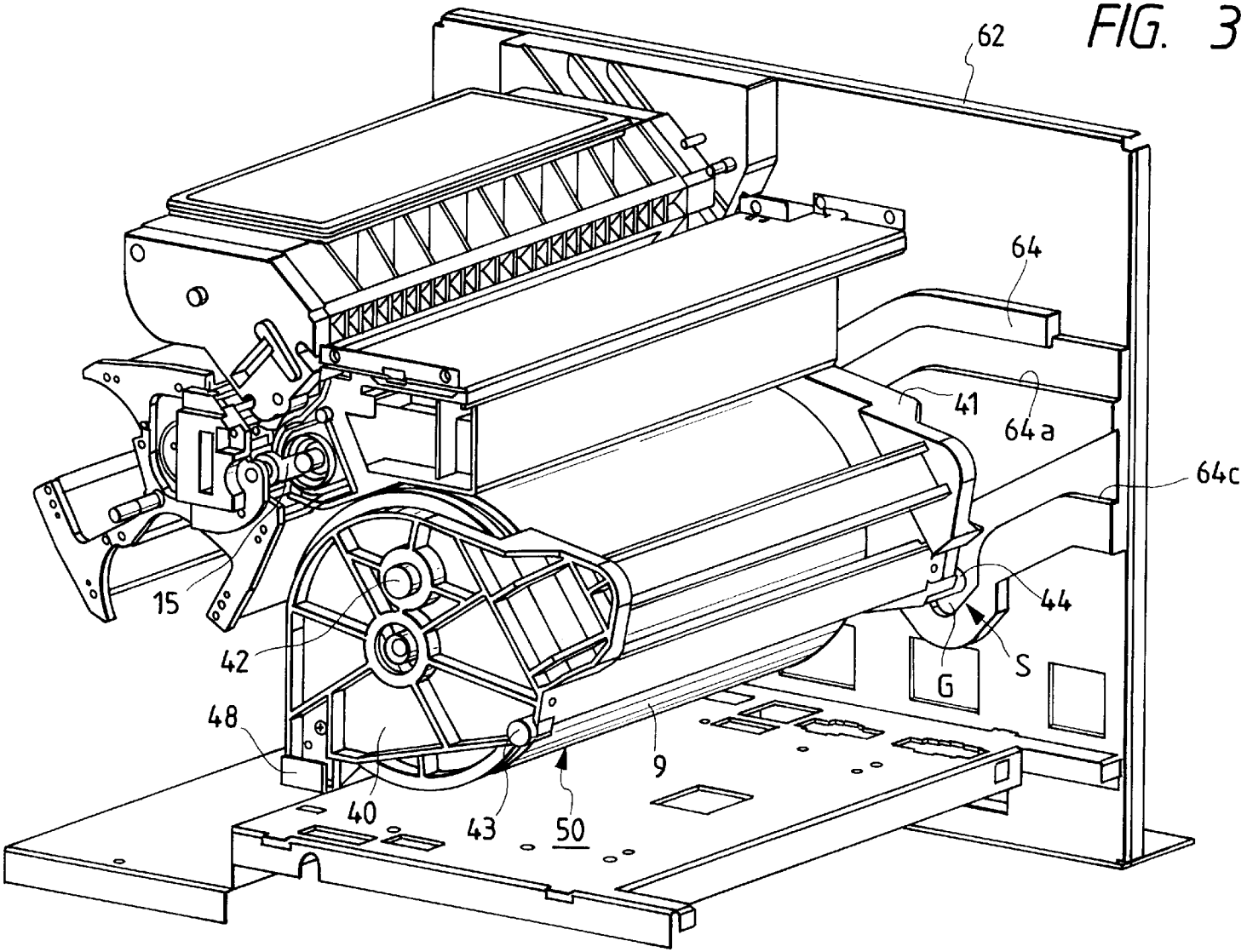
FIG. 3 is a perspective view for explaining the mounting, dismounting and rocking of the intermediate transfer member unit of FIG. 1 with respect to the image forming apparatus.
Figure 5:
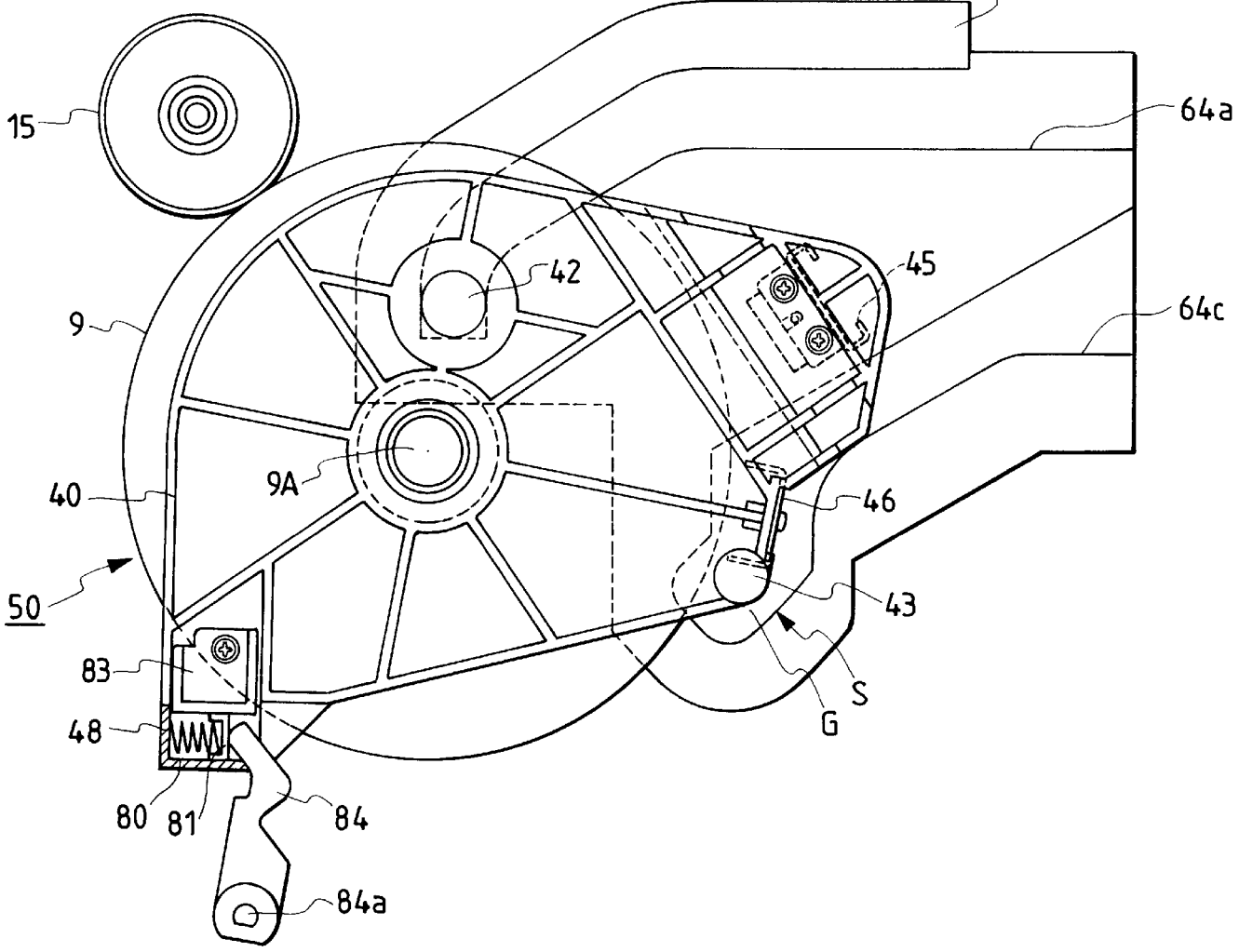
FIG. 5 is a fragmental side view of a pressure member containing portion, for explaining the mounting, dismounting and rocking of the intermediate transfer member unit of FIG. 1 with respect to the image forming apparatus, and showing a condition that the intermediate transfer member unit is contacted with the image bearing member.

As can be understood from FIGS. 4 and 5 as well as FIGS. 1 to 3, in order to contact the intermediate transfer member 9 with the image bearing member 15, the holding members 40, 41 have pressure member containing portions 48. The pressure member containing portions 48 contain compression springs 80 which are adapted to pushed by levers 84 of the printer to urge the intermediate transfer member 9 against the image bearing member 15 with appropriate pressure.

FIG. 4 shows a condition that the intermediate transfer member unit 50 is mounted to the printer. In FIG. 4, since the levers 84 of the printer are positioned at a retard position for the intermediate transfer member unit 50, the intermediate transfer member 9 is spaced apart from the image bearing member 15. In the illustrated embodiment, although the intermediate transfer member 9 is separated from the image bearing member 15 by its own weight, the intermediate transfer member may be separated from the image bearing member in synchronicity with the levers 84. In this condition, the posture controlling protruded guide members 43, 44 abut against the guide surfaces 63*c*, 64*c* of the guiding members 63, 64. In this condition, the intermediate transfer member unit 50 can be dismounted from the printer at any time with the predetermined posture.

As well as the compression springs 80, cap members 81 are contained in the pressure member containing portions 48 through which the levers 84 can easily push the springs and the springs 80 can easily be compressed and extended within the pressure member containing portions 48. Further, the cap members 81 abut against stoppers 82 of the holding members to prevent the springs 80 from escaping from the containing portions. Removing openings 85 for the compression springs 80 and the cap members 81 are covered by cover members 83 to prevent the springs 80 and the cap members 81 from escaping from the containing portions.

FIG. 5 shows a condition that the intermediate transfer member 9 abuts against the image bearing member 15. By handling the levers 84, the levers 84 are rotated around lever fulcrums 84*a* from the retard position, thereby pushing the cap members 81 and the compression springs 80. As a result, the intermediate transfer member unit 50 is rocked around the protruded guide members 42 to urge the intermediate transfer member 9 against the image bearing member 15. The urging pressure can be adjusted by the spring forces of the compression springs 80.

The levers 84 are stopped after they depress the springs by a predetermined amount. Accordingly, urging pressure between the intermediate transfer member 9 and the image bearing member 15 is maintained to an appropriate value. Further, merely by releasing the levers 84, the condition shown in FIG. 4 is restored, and, thus, the intermediate transfer member unit 50 can be dismounted from the printer with the predetermined posture.

In this way, according to the color image forming apparatus according to the present invention, the intermediate transfer member 9 can easily be handled, the intermediate transfer member unit 50 can easily be mounted and dismounted with respect to the printer between the side plates 61, 62, and the intermediate transfer member 9 can easily be contacted with or separated from the image bearing member 15 by rocking the unit around the protruded guide members 42.

As mentioned above, in the color image forming apparatus according to the present invention, the intermediate transfer member unit is formed by providing the holding members on both side of the intermediate transfer member and by interconnecting the holding members to each other, and the intermediate transfer member unit can be removably mounted to the image forming apparatus. Thus, the handling ability can be improved without greatly removing the frame of the apparatus, and, thus, the reduction of the rigidity of the apparatus and the deterioration of the image quality can be prevented. Further, the intermediate transfer member unit can easily be mounted and dismounted with respect to the apparatus without any interference, and the intermediate transfer member 9 can easily be contacted with or separated from the image bearing member 15.

What is claimed is:

1. An image forming apparatus comprising:

an electrophotographic photosensitive member;

image forming means for forming color toner images on said photosensitive member;

a drum-shaped intermediate transfer member which is rotated and to which the color toner images are successively transferred superimposedly; and transfer means for transferring the color toner images transferred to said intermediate transfer member onto a transfer material collectively, wherein said intermediate transfer member includes holding plates at both sides, connecting members interconnecting said side holding plates, and protrusion-like guide members which slide on guiding members of said image forming apparatus and which cause said intermediate transfer member to rock around a shaft different from a rotational center thereof, and wherein the mounting and dismounting of said intermediate transfer member to or from said image forming apparatus is effected by shifting said holding plates along a shifting direction of said intermediate transfer member by using said holding plates as grips.

2. An image forming apparatus comprising:

an electrophotographic photosensitive member;

image forming means for forming color toner images on said photosensitive member;

a drum-shaped intermediate transfer member which is rotated and to which the color toner images are successively transferred superimposedly; and transfer means for transferring the color toner images transferred to said intermediate transfer member onto a transfer material collectively, wherein said intermediate transfer member includes holding plates at both sides, connecting members interconnecting said side holding plates, and protrusion-like guide members which slide on guiding members of said image forming apparatus and which cause said intermediate transfer member to rock around a shaft different from a rotational center thereof, wherein said image forming apparatus further includes pressurizing means for urging said holding plates toward said photosensitive member when said guide members reach predetermined positions of said guiding members, and wherein the mounting and dismounting of said intermediate transfer member to or from said image forming apparatus is effected by shifting said holding plates along a shifting direction of said intermediate transfer member by using said holding plates as grips.

3. An image forming apparatus, comprising:

an image bearing member for bearing an image thereon;

a rotatable rotary member forming a nip between it and said image bearing member for transferring the image on said image bearing member;

a holding member for holding said rotary member, said holding member being provided with a guided member; and a guiding member for guiding said guided member so that a rotary member unit including said holding member and said rotary member is attachable to or detachable from a main body of said image forming apparatus, said guiding member being provided on the main body of said image forming apparatus, wherein said rotary member unit is attachable to or detachable from the main body of said image forming apparatus in a direction intersecting with a longitudinal direction of said rotary member.

4. An image forming apparatus according to claim 3, wherein said rotary member unit is provided with a grip portion to be gripped when attaching or detaching said rotary member unit to or from the main body of said image forming apparatus.

5. An image forming apparatus according to claim 3, wherein said rotary unit is pulled out upwardly from a position where it is attached to the main body of said image forming apparatus.

6. An image forming apparatus according to claim 3, wherein said holding member is provided with a plurality of said guided members at an end portion of said rotary member in the longitudinal direction thereof.

7. An image forming apparatus according to claim 6, wherein a plurality of said guiding members for guiding said plurality of guided members are provided.

8. An image forming apparatus according to claim 6, wherein said guided member is provided with a protrusion.

9. An image forming apparatus according to claim 6, wherein one of said plurality of guided members is provided at a position different from a rotational shaft of said rotary member to form a rocking center around which said rotary member rocks relative to said image bearing member.

10. An image forming apparatus according to claim 9, further comprising a pressuring member for pressurizing said rotary member toward said image bearing member with a predetermined pressure.

11. An image forming apparatus according to claim 3, wherein said rotary member unit is attachable to or detachable from the main body of said image forming apparatus in a direction orthogonal to a longitudinal direction of said rotary member.

12. An image forming apparatus according to one of claims 3 to 11, wherein said rotary member is an intermediate transfer member to which the image on said image bearing member is transferred at the transfer nip.

13. An image forming apparatus according to claim 12, wherein said image bearing member can bear images of a plurality of colors thereon which are sequentially superimposed on said intermediate transfer member at the transfer nip to be transferred to a transfer material as a whole.

* * * * *

UNITED STATES PATENT AND TRADEMARK OFFICE

CERTIFICATE OF CORRECTION

PATENT NO. : 5,822,655

DATED : October 13, 1998

INVENTOR : MASAYUKI IKEDA

It is certified that error appears in the above-identified patent and that said Letters Patent is hereby corrected as shown below:

COLUMN 2,
Line 27, "synchronous" should read --synchronicity--.

COLUMN 4,
Line 3, "paths" should read --path--;
Line 33, "conditions" should read --condition--; and
Line 34, "be ring" should read --bearing--.

COLUMN 6,
Line 39, "is" should read --are--.

COLUMN 11,
Line 47, "pushed" should read --be pushed--.

COLUMN 12,
Line 40, "side" should read --sides--.

Signed and Sealed this

Eighteenth Day of May, 1999

*Attest:*

Q. TODD DICKINSON

*Attesting Officer*

*Acting Commissioner of Patents and Trademarks*